US007032357B2

(12) United States Patent
Cooper et al.

(10) Patent No.: US 7,032,357 B2
(45) Date of Patent: Apr. 25, 2006

(54) BRIDGING MEMBER FOR CONCRETE FORM WALLS

(75) Inventors: Bruce Cooper, Northumberland (CA); G. Richie Scott, Dundalk (CA); Robert E. Sculthorpe, Northumberland (CA); Graham A. Knowles, Petersborough (CA)

(73) Assignee: ARXX Building Products, Inc., Cobourg (CA)

( * ) Notice: Subject to any disclaimer, the term of this patent is extended or adjusted under 35 U.S.C. 154(b) by 0 days.

(21) Appl. No.: 10/266,635

(22) Filed: Oct. 9, 2002

(65) Prior Publication Data

US 2003/0029106 A1 Feb. 13, 2003

Related U.S. Application Data

(63) Continuation of application No. 09/937,440, filed as application No. PCT/IB99/00672 on Mar. 30, 1999, now abandoned.

(51) Int. Cl.
*E04B 2/86* (2006.01)

(52) U.S. Cl. ..... 52/426; 52/442; 52/309.11; 52/431

(58) Field of Classification Search ..... 52/426, 52/442, 431, 309.11
See application file for complete search history.

(56) References Cited

U.S. PATENT DOCUMENTS

| | | | |
|---|---|---|---|
| 963,776 | A | 7/1910 | Kosack |
| 1,033,461 | A | 7/1912 | Peterson |
| 1,069,821 | A | 8/1913 | Sherwood |
| 1,619,947 | A | 3/1927 | J.F. Makowski |
| 1,721,685 | A | 7/1929 | G.B. Bosco |
| 1,914,770 | A | 6/1933 | Duncan |
| 1,953,287 | A | 4/1934 | Bemis |
| 1,973,941 | A | 9/1934 | Anderson |
| 2,185,335 | A | 1/1940 | Fischer |
| 2,316,819 | A | 4/1943 | Tedrow |
| 2,535,277 | A | 12/1950 | Fama |
| 2,750,648 | A | 6/1956 | Hallock |

(Continued)

FOREIGN PATENT DOCUMENTS

| | | |
|---|---|---|
| CA | 826584 | 11/1969 |
| CA | 1 063 822 | 10/1979 |

(Continued)

OTHER PUBLICATIONS

Formtech International Corporation, Building the Future, "Finally a cost effective replacement for traditional wood forms . . . "; http://www.formtechsys.com.

(Continued)

*Primary Examiner*—Basil Katcheves
(74) *Attorney, Agent, or Firm*—McGuireWoods LLP

(57) ABSTRACT

A building component having first and second high density foam panels and improved bridging members for connecting the panels that extend between and may be molded into the panels. The bridging members include a pair of elongated end plates oriented in a top to bottom direction of the panels, a pair of substantially identical web members joining the end plates and being substantially symmetrically disposed above and below a central horizontal axis of the bridging member, and a pair of strip members oriented in the top to bottom direction of the panels intersecting the web members. The web members have a unique configuration that maximizes load bearing capacity with a minimum amount of material. The strip members may abut against and be substantially flush with respective inner surfaces of the foam panels to assist in positioning and forming the panels during molding. Seating areas for positioning horizontally and/or vertically disposed rebar in predetermined positions are also provided.

16 Claims, 5 Drawing Sheets

U.S. PATENT DOCUMENTS 2,911,818 A 11/1959 Smith
3,174,203 A 3/1965 Kemper
3,286,428 A 11/1966 Kay
3,353,315 A 11/1967 Barker
3,383,817 A 5/1968 Gregori
3,410,044 A 11/1968 Moog
3,475,873 A 11/1969 Steadman
3,552,076 A 1/1971 Gregori
3,591,123 A 7/1971 Edwards
3,734,453 A 5/1973 Bailey
3,767,158 A 10/1973 Mikus
3,772,842 A 11/1973 Barbera
3,778,949 A 12/1973 Hellerich
3,782,049 A 1/1974 Sachs
3,788,020 A 1/1974 Gregori
3,800,015 A 3/1974 Sachs
3,817,006 A 6/1974 Williams
3,902,296 A 9/1975 Thomas
3,985,329 A 10/1976 Liedgens
4,116,415 A 9/1978 Ward
4,147,483 A 4/1979 Rovera et al.
4,177,617 A 12/1979 DeLuca et al.
4,223,501 A 9/1980 DeLozier
4,226,067 A 10/1980 Artzer
4,229,920 A 10/1980 Lount
4,290,576 A 9/1981 Schwörer
4,333,289 A 6/1982 Strickland
4,336,676 A 6/1982 Artzer
4,397,441 A 8/1983 Manderla
4,426,061 A 1/1984 Taggart
4,516,372 A 5/1985 Grutsch
4,655,014 A 4/1987 Krecke
4,698,947 A 10/1987 McKay
4,706,429 A 11/1987 Young
4,730,422 A 3/1988 Young
4,731,968 A 3/1988 Obino
4,742,659 A 5/1988 Meilleur
4,765,109 A 8/1988 Boeshart
4,805,366 A 2/1989 Long
4,866,891 A 9/1989 Young
4,879,855 A 11/1989 Berrenberg
4,884,382 A 12/1989 Horobin
4,889,310 A 12/1989 Boeshart
4,894,969 A 1/1990 Horobin
4,901,494 A 2/1990 Miller et al.
4,936,540 A 6/1990 Boeshart
4,938,449 A 7/1990 Boeshart
4,949,515 A 8/1990 Krecke
4,967,528 A 11/1990 Doram
5,003,746 A 4/1991 Wilston
5,065,561 A 11/1991 Mason
5,074,088 A 12/1991 Bergeron et al.
5,107,648 A 4/1992 Roby
5,154,032 A 10/1992 Ritter
5,212,920 A 5/1993 Tye
5,248,122 A 9/1993 Graham
5,371,990 A 12/1994 SalahUddin
5,390,459 A * 2/1995 Mensen ..... 52/426
5,409,193 A 4/1995 Baxter
5,428,933 A 7/1995 Philippe
5,459,971 A 10/1995 Sparkman
5,570,552 A 11/1996 Nehring
5,572,838 A 11/1996 Truitt et al.
D378,049 S * 2/1997 Boeshart ..... D8/354
5,625,989 A 5/1997 Brubaker et al.
5,657,600 A * 8/1997 Mensen ..... 52/426
5,692,356 A 12/1997 Baxter
5,701,710 A 12/1997 Tremelling
5,704,180 A 1/1998 Boeck
5,709,060 A 1/1998 Vaughan et al.
5,709,808 A 1/1998 Lee
5,735,093 A 4/1998 Grutsch
5,809,727 A 9/1998 Mensen
5,809,728 A 9/1998 Tremelling
5,845,445 A 12/1998 Blackbeard
5,861,105 A 1/1999 Martineau
5,887,401 A 3/1999 Moore, Jr.
5,896,714 A * 4/1999 Cymbala et al. ..... 52/426
6,044,614 A 4/2000 Bryant
6,170,220 B1 1/2001 Moore, Jr.
6,230,462 B1 * 5/2001 Beliveau ..... 52/426
6,237,890 B1 5/2001 Gates
6,240,693 B1 6/2001 Komasara et al.
6,247,280 B1 6/2001 Grinshpun et al.
6,250,024 B1 6/2001 Sculthorpe et al.
6,260,816 B1 7/2001 Valero Salinas
6,272,810 B1 8/2001 Ingram et al.
6,289,638 B1 9/2001 Vasseur
6,293,068 B1 9/2001 Harrington, Jr.
6,314,694 B1 * 11/2001 Cooper et al. ..... 52/309.12
6,314,697 B1 11/2001 Moore, Jr.
6,318,040 B1 11/2001 Moore, Jr.
6,321,496 B1 11/2001 Martin, Jr.
6,321,497 B1 11/2001 Cormier
6,321,498 B1 11/2001 Trovato
6,322,043 B1 11/2001 Saervoll
6,336,301 B1 1/2002 Moore, Jr.
6,363,683 B1 4/2002 Moore, Jr.
6,401,419 B1 6/2002 Beliveau
6,435,471 B1 8/2002 Piccone
6,438,918 B1 8/2002 Moore, Jr. et al.
6,481,178 B1 11/2002 Moore, Jr.
2001/0004819 A1 6/2001 Reymann
2001/0027630 A1 10/2001 Moore, Jr. et al.
2001/0032431 A1 10/2001 Grinhpun et al.
2001/0047632 A1 12/2001 Yost et al.
2002/0017070 A1 2/2002 Batch
2002/0047082 A1 4/2002 Jackson et al.
2002/0069532 A1 6/2002 Meilleur
2002/0078649 A1 6/2002 Clapp
2002/0092253 A1 7/2002 Beliveau
2002/0104279 A1 8/2002 Beliveau
2002/0116889 A1 8/2002 Moore, Jr.
2002/0116890 A1 8/2002 Moore, Jr.
2002/0116894 A1 8/2002 Reid
2002/0162294 A1 11/2002 Beliveau
2002/0178676 A1 12/2002 Yost et al.
2003/0005659 A1 1/2003 Moore, Jr.
2003/0029108 A1 2/2003 Neuhaus, III et al.
2003/0033776 A1 2/2003 Schmidt
2003/0033781 A1 2/2003 Schmidt
2003/0089076 A1 5/2003 Kuo
2004/0040240 A1 3/2004 Patz et al.

FOREIGN PATENT DOCUMENTS

CA 1 092 846 1/1981
CA 1 145 584 5/1983
CA 1 154 278 9/1983
CA 1 182 304 2/1985
CA 1 194 706 10/1985
CA 1 209 364 8/1986
CA 1 233 042 2/1988
CA 1 234 701 4/1988
CA 1 303 377 6/1992
CA 1 304 952 7/1992
CA 2 118 343 4/1996
CA 2 219 414 5/1998
CA 2 298 435 9/1998
CA 2 402 580 9/1998
CA 1 244 668 11/1998
CA 2 159 318 11/1999
CA 2 256 261 6/2000

| | | |
|---|---|---|
| CA | 2 367 016 | 10/2000 |
| CA | 2 302 972 | 9/2001 |
| CA | 2 209 251 | 10/2001 |
| CA | 2 142 517 | 4/2002 |
| CA | 2 243 905 | 5/2002 |
| CA | 2 193 630 | 7/2002 |
| CA | 2 224 949 | 8/2002 |
| CA | 2 353 305 | 8/2002 |
| CA | 2 373 769 | 8/2002 |
| CA | 2 373 770 | 8/2002 |
| CA | 2 346 328 | 11/2002 |
| CA | 2 358 195 | 11/2002 |
| CA | 2 360 710 | 4/2003 |
| CA | 2 389 313 | 9/2003 |
| DE | 1 037 105 | 8/1958 |
| DE | 21 11 730.6 | 12/1972 |
| DE | 2 203 396 | 8/1973 |
| DE | 2 255 810 | 3/1974 |
| DE | 24 26 762 | 5/1975 |
| DE | 28 04 402 A1 | 8/1978 |
| DE | 29 17 024 A1 | 11/1979 |
| EP | 0 405 040 A1 | 1/1991 |
| EP | 0 591 080 A1 | 4/1994 |
| EP | 1 378 399 A1 | 1/2004 |
| FR | 1 384 868 | 11/1964 |
| FR | 2 543 598 | 10/1984 |
| GB | 1 188 549 | 4/1970 |
| GB | 1 497 348 | 1/1978 |
| WO | WO 94/04768 | 3/1994 |
| WO | WO 98/40577 | 9/1998 |
| WO | WO 00/45004 | 8/2000 |
| WO | WO 00/61879 | 10/2000 |
| WO | WO 01/59227 A1 | 8/2001 |

OTHER PUBLICATIONS

Formtech International Corporation, Building the Furture, "Company Overview", http://www.formtechsys.com/products.php3.
Greenblock, "What is Greenblock", pp. 1-5.
Greenblock EPS ICF Building System, "The Most Significant Innovation in the Building Industry in the Last 30 Years".
Argisol, "The energy conscious system of construction for quick, cost effective building".
Argisol, "Build R-2000 Quality with Argisols R-22 + Walls".
R.K. Vassbotn, "Letter to Ken Reel, Secretary of The Building Code Evaluation Committee (with attachments)", The Corporation of the City of North Bay, Jan. 28, 1993.
Greenblock WorldWide Corporation, "Greenblock Abbreviated Technical Review", 1995.
Hansen Construction Supply, "Reddi-Form Revolutionizes Construction with an Advanced Building System that Delivers Outstanding Quality at Substantial Savings", EPS Building Systems.
Conform.
Lite-Form T-Intersection using T-Tie, "Assembly Instructions".
AFM Corporation, "Diamond Snap-Form; Detail Book".
Consulwal, "Concrete Forming, Concrete Block Construction".
W.A.M. Inc., "The Ice (Insulate Concrete Efficiently) Block".
PLASTBAU-3, Elemento Cassero Isolante Premontato, Prearmato per Setti Portanti di Cemento Armato.

* cited by examiner

BRIDGING MEMBER FOR CONCRETE FORM WALLS

This is a continuation of application(s) application Ser. No. 09/937,440, which entered the National Stage in the U.S. under 35 U.S.C. 371 on Sep. 27, 2001 now abandoned from International Application Serial No. PCT/IB99/00672 filed Mar. 30, 1999, the contents of both applications being incorporated herein by reference.

BACKGROUND OF THE INVENTION

1. Field of the Invention

This application relates to a building component of the type which is used to build up insulated concrete form ("ICF") walls in building construction, and more particularly to an improved bridging member used to connect the opposed insulated panels of an ICF.

2. Background of the Invention

In conventional construction in North America, concrete walls are normally produced by constructing form walls, pouring concrete into the space between the form walls and, upon the setting of the concrete, removing the form walls. Finishing materials are then added to the concrete walls as required.

Typically in residential construction, concrete basements and other concrete walls will be constructed in the manner discussed above and wood framing will be constructed as required on top of or beside the walls. Insulation will be inserted between the framing members and the wall finished inside and out as desired.

Clearly, both parts of this construction are inefficient. It is time-consuming and wasteful of materials to have to remove the form walls after the concrete walls are poured. Furthermore, it is now common to insulate all walls, including basement walls, particularly in colder climates, and framing and insulation must be installed separately inside the walls.

The piecemeal construction, which is inherent in the wood frame part of the structure is labor-intensive and expensive. As a result, there have been ongoing efforts for many years to provide more modular types of wall construction from which efficiencies can be gained. One such construction type is that with which the invention is concerned.

A system has been in use that combines a number of the operations normally associated with residential and other building construction to provide savings in materials, energy, etc. This system basically includes the use of a foam insulating material to construct permanent form walls. The form walls are constructed and the concrete poured and the form walls are then left in place. The concrete walls so formed need not be confined to basement walls, but may comprise all of a building's walls. No further insulation is necessary, and finishing materials may be applied to the interior and exterior of the wall as required.

A particularly advantageous type of ICF is disclosed in U.S. Pat. No. 5,567,600, the disclosure of which is incorporated by reference herein in its entirety. The '600 patent discloses a building component formed from two foam panels secured together by at least two bridging members. Each bridging member includes a pair of elongated end plates joined by a narrow strip member, a series of first narrow bracing members extending from adjacent a mid-point of the narrow strip member to positions spaced a short distance from the ends of the end plates, and a series of second narrow bracing members extending from positions on the first bracing members to positions on the strip member intermediate the plates and the mid-point of the strip member. While the component disclosed in this patent has numerous advantages, works well and has been commercially successful for a number of years, the bridging members used to connect the form walls do not make the most efficient use of the material from which they are constructed to resist lateral forces generated by the concrete or other building material poured in between the form walls. When more material is used to form the structural members than is actually required to withstand tensile and other loads, the resulting form walls are unnecessarily expensive and heavy. Existing ICF systems thus far proposed, while in many cases are very useful, suffer from these or other similar disadvantages.

Against this background, the invention provides a building component for use in such an ICF system, which when integrated into a wall construction, offers advantages over and avoids the drawbacks and disadvantages of the prior ICF systems.

SUMMARY OF THE INVENTION

It has now been discovered that substantial advantages can be obtained where the building component used to build up an ICF wall includes bridging members that are engineered to combine an enhanced strengthening and reinforcing grid with a substantial reduction in material. Structural analysis of the bridging members has been performed to arrive at the invention using finite element analysis methods. The resulting structure of the bridging members achieves optimized strength from a minimized amount of material by the unique configuration of web members that form part of the bridging members. The web members of the invention are configured to use material in the most efficient manner such that the bridging member can resist larger loads or resist the same loads with less deflection than known structural members used to produce similar form walls.

The invention achieves these advantages by providing a building component that includes first and second high density foam panels, each having inner and outer surfaces, top and bottom, and first and second ends. The panels are typically arranged in spaced parallel relationship with their inner surfaces facing each other. At least two bridging members connect the panels, and preferably, although not necessarily, extend between and through and are molded into the panels. Each of the bridging members includes a pair of elongated end plates oriented in the top-to-bottom direction of the panels. A pair of substantially identical web members join the end plates together and are symmetrically disposed above and below a central horizontal axis of the bridging member. A pair of strip members, generally oriented in the top-to-bottom direction of the panels, are symmetrically disposed on opposite sides of a central vertical axis of the bridging member such that they are substantially flush with respective inner surfaces of the foam panels. The strip members intersect the pair of web members at positions above and below the central horizontal axis of the bridging member.

The strip members maybe ski-shaped with top and bottom ends curved toward a respective end plate. The strip members are wider than the web members in a direction parallel to the end plates or in the first-to-second end direction of the foam panels. The web members each include a mid-portion having seating areas formed therein for positioning rebar relative to the bridging member and the foam panels.

The seating areas on the mid-portions of the web members can be formed on sides of the web members towards the top and bottom of the foam panels, as well on sides of the web members towards the first and second ends of the panels. The seating areas formed on the sides of the web members toward the top and bottom of the foam panels provide guide surfaces for horizontal rebar and the seating areas formed on the sides of the web members toward the first and second ends of the panels provide guide surfaces for vertical rebar. The seating areas are particularly useful for forms used to make 4" walls, which have reduced clearances compared to larger walls. A novel V-shaped seating area for horizontal rebar can be formed with a vertically oriented outer edge such that any size rebar seated in the seating area will be positioned with a constant distance between the outer edge of the rebar and the outer edge of the concrete or other pourable building material. The advantage of positioning horizontal rebar with a controlled minimum amount of concrete or other pourable building material between the outer edge of the rebar and the outer surface of the concrete is especially important with the forms used to make 4" walls. The horizontal and vertical rebar seating features of the invention can be employed on bridging members of any design in which rebar is used.

Each of the web members that connect the end plates may have a substantially X-shape. Alternatively, the web members may each have a substantially X-shaped portion or a double Y-shaped portion in the area between the pair of strip members. In this embodiment, the ends of the X-shaped or double Y-shaped portions merge at the strip members with V-shaped portions. The V-shaped portions connect the end plates of the bridging member to the substantially X-shaped or double Y-shaped portions. The web members, V-shaped portions and end plates that form the bridging member may be constructed integrally from high density plastic, such as polypropylene or polyethylene, or may be formed separately and snap-fit together using conventional means known in the art. In particular, the V-shaped portions and end plates may be integrally formed and snap-fit to the web members.

The configurations of the web members of the invention have been determined by finite element-type structural analysis to have an improved ability to resist and uniformly distribute the lateral forces exerted by wet concrete or other pourable building materials poured in between the form panels. The V-shaped portions of the web members that make up the opposite end portions of the bridging member define truss-like members having increased open areas compared to existing designs for the foam that makes up the form walls to pass through the web members, thereby increasing the aggregate strength of the foam panels at the web/foam panel interface.

A further advantage of the finite element designed web members of the invention is the increased ability of the end plates to resist downward loads exerted by finishing materials attached to the end plates of a building component after construction of a wall. The substantially symmetrical design of the web members also enhances the stacking ability of the bridging members for transportation and storing purposes. Another factor in determining the configuration of the web members, is the ability to stack the completed building components formed from the bridging members and the foam panels. The preferred configuration of the web members allows for a greater number of completed building components to be stacked in the same height, thereby increasing the number of components that can be carried per shipping container. Stacking pins can also be provided extending from the sides of the web members to assist in positioning bridging members relative to each other in stacks before they are joined with the foam panels.

The symmetrically disposed strip members oriented in the top to bottom direction of the panels and extending to a width greater than the web members in a direction parallel to the end plates provide further advantages during the manufacturing of the building component. The shape and positioning of the strip members enhances their ability to resist the pressure of expanding foam during the process of molding the foam panels about the opposite end portions of the bridging member. The strip members also serve a structural function in assisting to resist downward loads imposed by finishing materials attached to the wall.

It is to be understood that both the foregoing general description and the following detailed description are exemplary and explanatory and are intended to provide explanation and context for the invention, the scope of which is limited solely by the appended claims.

BRIEF DESCRIPTION OF THE DRAWINGS

The accompanying drawings, which are included to provide a further understanding of the invention and are incorporated in and constitute a part of the specification, illustrate preferred embodiments of the invention and together with the detailed description below serve to explain the principles of the invention. In the drawings.

DESCRIPTION OF THE PREFERRED EMBODIMENTS

Reference will now be made in detail to preferred embodiments of the invention, examples of which are illustrated in the accompanying drawings.

Figure 1:
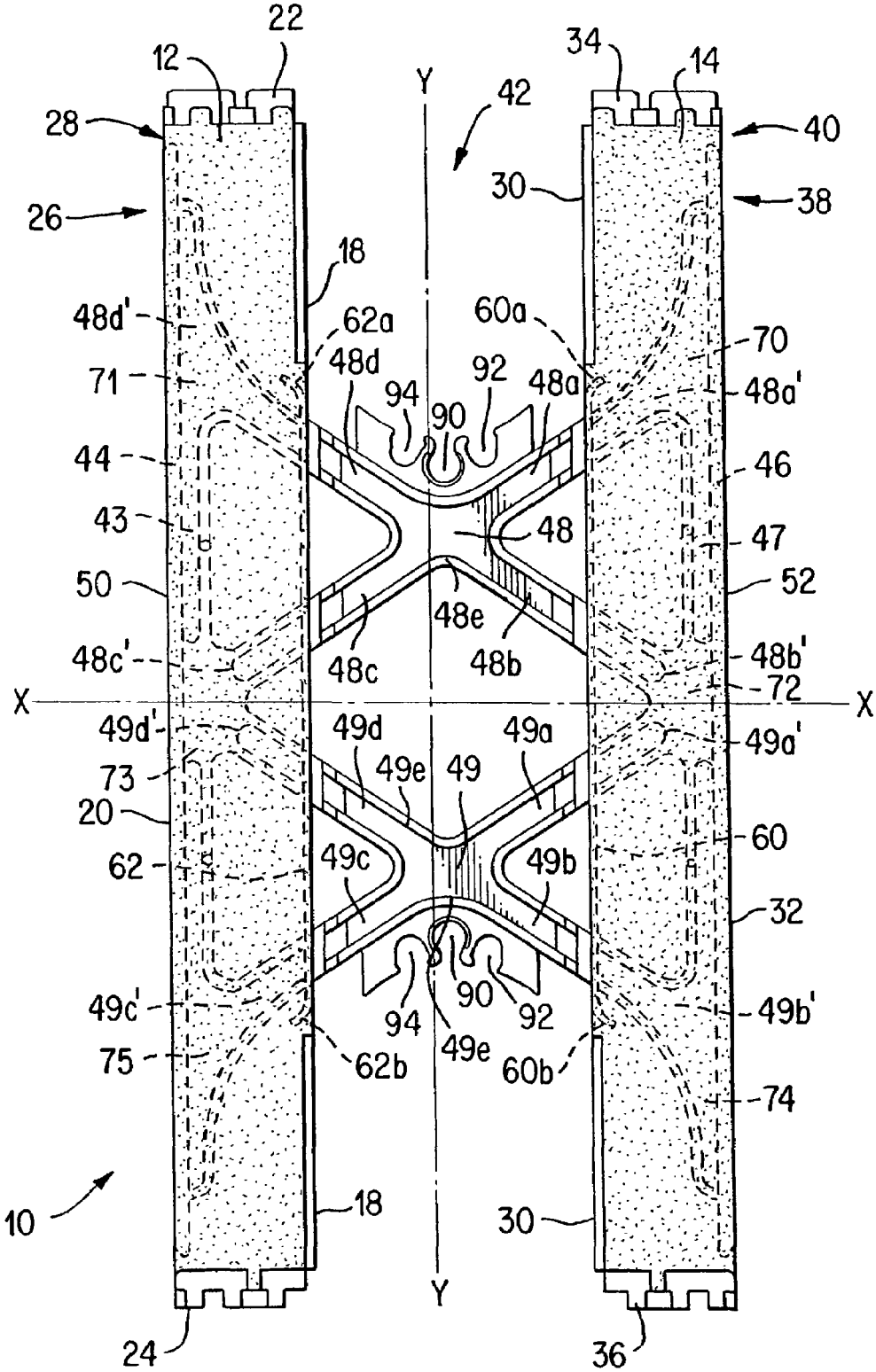
FIG. 1 is a side elevation view of a building component having a bridging member formed from substantially X-shaped web members constructed according to a first embodiment of the invention.
Figure 2:
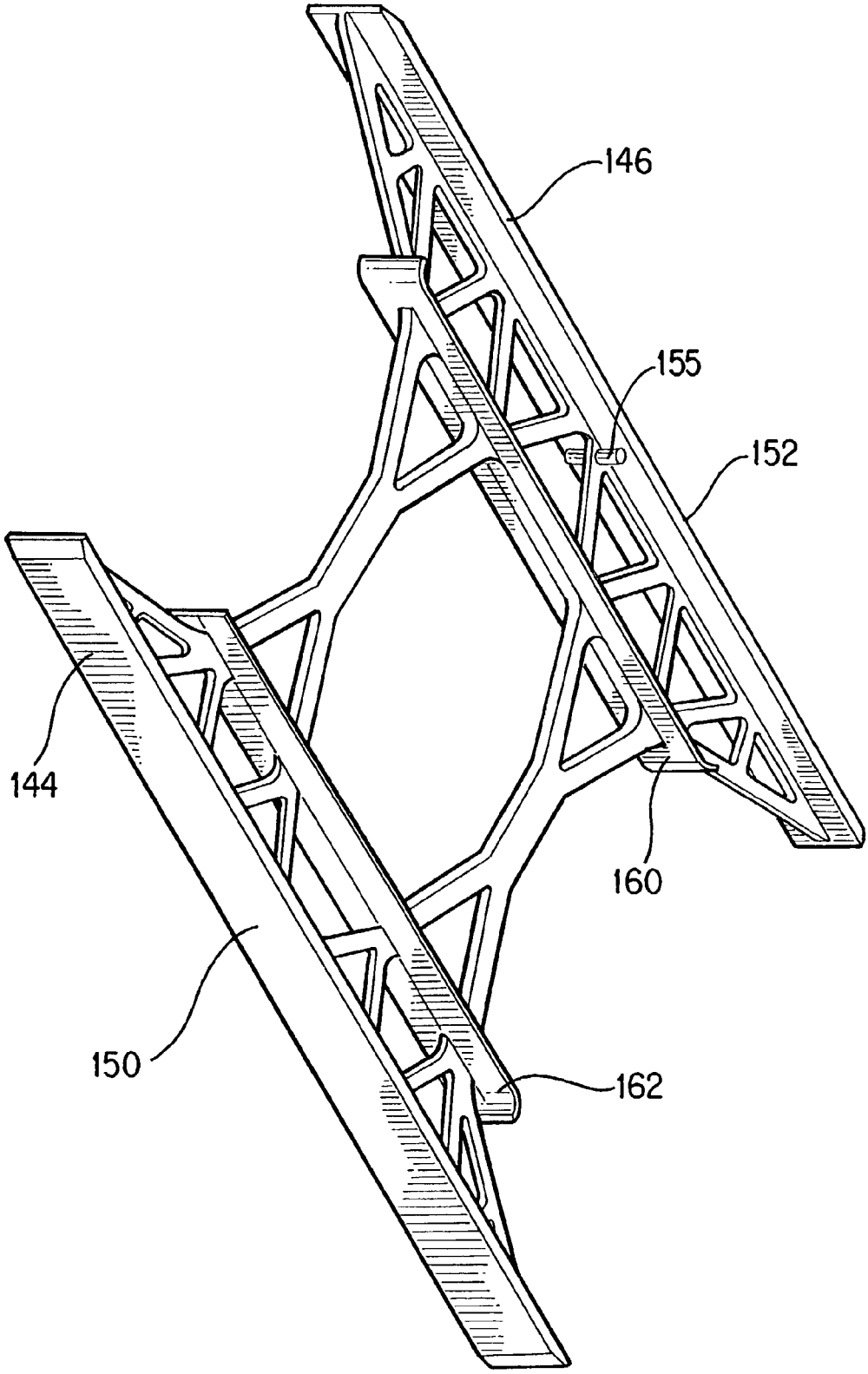
FIG. 2 is a perspective view of a bridging member having double Y-shaped web members constructed according to a second embodiment of the invention.
Figure 3:
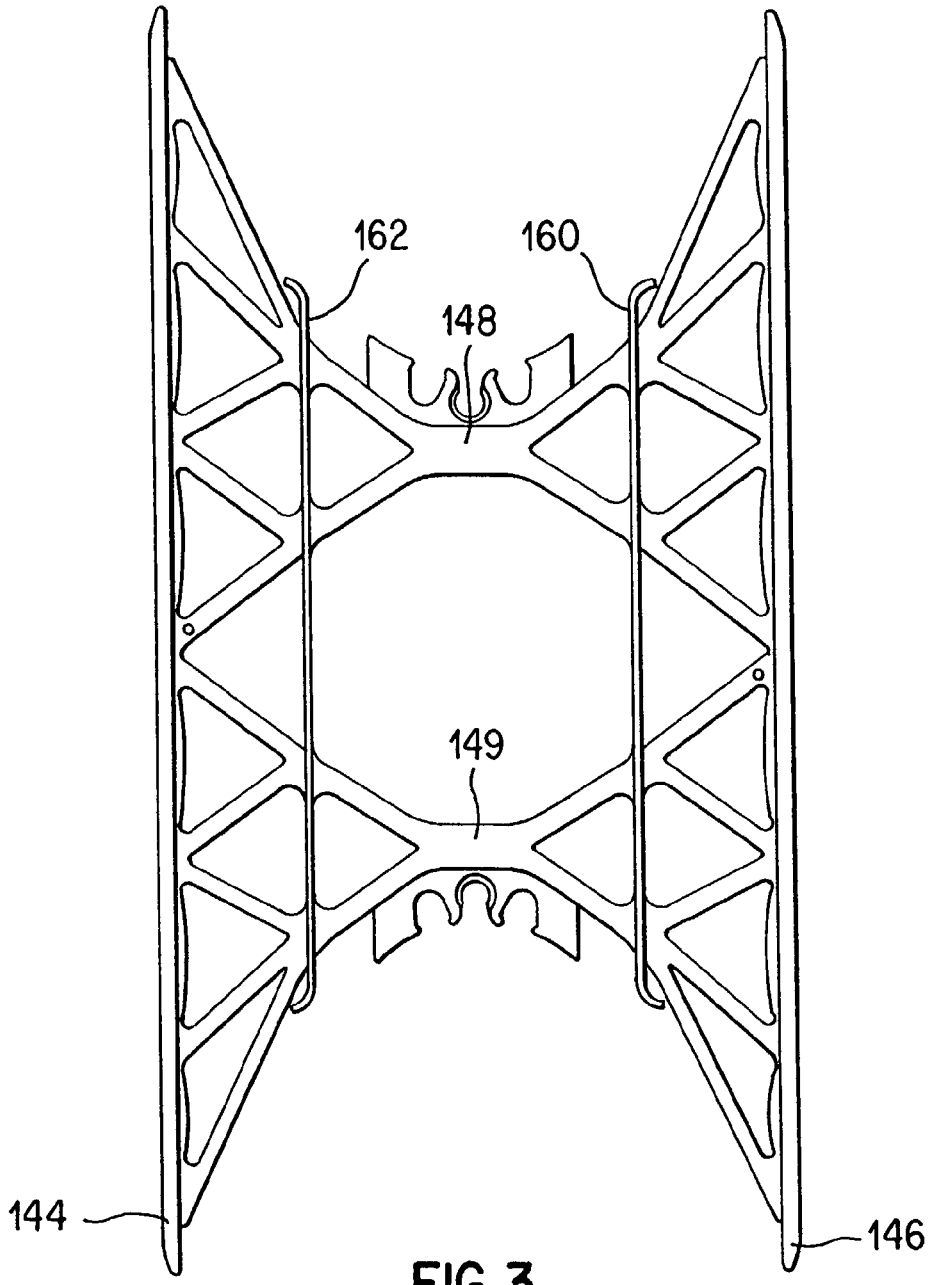
FIG. 3 is a side elevation view of a bridging member having double Y-shaped web members constructed according to a third embodiment of the invention.
Figure 4:
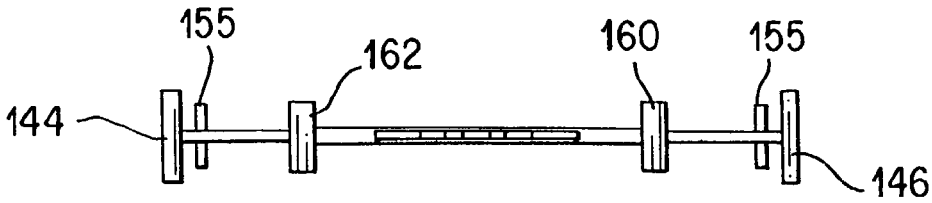
FIG. 4 is a top plan view of the bridging member of FIG. 3.

An ICF building component 10 shown in FIG. 1 comprises first and second insulating foam panels 12 and 14 secured together by at least two bridging members 42, which can generally be thought of as any structure used to connect the panels together consistent with the purposes and objectives of the invention.

Panel 12 has inner and outer surfaces 18 and 20 respectively, top and bottom 22 and 24 respectively, and first and second ends 26 and 28. Panel 14 has inner and outer surfaces 30 and 32, top and bottom 34 and 36, and first and second ends 38 and 40.

The panels 12 and 14 can be formed from fire retardant expanded polypropylene, polystyrene, polyethylene or other suitable polymers with expanded polystyrene commonly referred to as "EPS" being preferred. Subject to indentations and protrusions of minor dimensions, which can be any structure used to connect the forms together vertically to form a wall as discussed below, the panels are of generally uniform rectangular cross-section. In a typical case, each panel may be 48 inches long, 16¾ inches high and 2⅝ inches thick.

Each bridging member 42 may be formed from a single integral unit molded of plastic, with the preferred plastic being high-density flame retardant polypropylene, is although flame retardant polyethylene, polystyrene and other suitable polymers may be used. Alternatively, the bridging member may be formed in separate pieces that in use are connected together by means known in the art, such as snap-fits or other connections. This permits the width of the finished wall to be selected at the job site and reduces the volume of the form for shipping.

In the embodiment of FIG. 1, bridging member 42 includes a pair of elongated end plates 44 and 46 joined by a pair of substantially identical web members 48 and 49, which are generally symmetrically disposed above and below a central horizontal axis X—X of the bridging member 42.

As shown in FIG. 1, the end plates 44 and 46 are recessed into the panels such that their outer surfaces 50 and 52, respectively, not only abut, but are substantially flush with, i.e., lie in the same plane, as the outer surfaces 20 and 32 of panels 12 and 14, respectively. End plates 44 and 46 are oriented in the top-to-bottom or vertical direction relative to the panels 12 and 14 as they would be positioned in use in a vertical wall.

A pair of ski-shaped strip members 60 and 62, whose function is described subsequently, is also oriented in the top-to-bottom direction of the panels 12 and 14 and are symmetrically disposed on opposite sides of a central vertical axis Y—Y of the bridging member 42 (when each panel has the same width). The strip members lie in planes that are generally parallel to the inner surfaces 18, 30 of the panels and perpendicular to the plane of the web members 48, 49.

Bridging members 42 preferably are molded into the panels 12 and 14 in the course of producing the panels such that opposite end portions of the bridging members (including the end plates and portions of the web members) are encased within the foam making up the panels. In the completed building component 10, strip member 60 abuts against and is flush with the inner surface 30 of panel 14 and strip member 62 abuts against and is flush with the inner surface 18 of panel 12. End plates 44 and 46 may be of substantially equal height as the panels 12 and 14 and may be substantially flush with the top and bottom ends of the panels, which does require them to extend completely to the ends. In fact, it is preferred for the end plates 44, 46 to stop a short distance from the ends of panels as shown in FIG. 1, which facilitates connection and stacking of the forms to build a wall. As described in U.S. Pat. No. 5,567,600, the end plates of stacked forms align to form continuous furring strips for attaching finishing materials to the completed wall. Of course, one of ordinary skill in the art will recognize that alternative embodiments of the invention include the end plates being completely buried within the foam panels 12 and 14, or being partially buried, in which case, portions of the end plates would be exposed, such as by the formation of openings through the foam panels, as is known in the art. The end plates could also extend above and/or below the top and bottom of the panels.

As shown in FIG. 1, each of the web members 48 and 49 has a substantially X-shaped configuration. The upper web member 48 has two diverging legs 48*a* and 48*b* extending from the central vertical axis Y—Y of the bridging member 42 toward the end plate 46. Diverging leg 48*a* merges with the end plate 46 at a distal end 48*a*' near the upper end 46*a* of the end plate 46. Diverging leg 48*b* merges with end plate 46 at its distal end 48*b*' near the center of the end plate 46.

On the opposite side of the vertical axis Y—Y diverging legs 48*d* and 48*c* merge with end plate 44 near the top end 44*a* of the end plate 44 and near a center portion of the end plate. Bridging member 42 is substantially symmetrical about horizontal axis X—X such that lower web member 49 similarly includes diverging legs 49*a* and 49*b* that merge with end plate 46 and diverging legs 49*d* and 49*c* that merge with end plate 44.

Along end plate 46, the distal end 48*a*' of diverging leg 48*a* widens into an enlarged area 70 at the inside surface of end plate 46. Diverging leg 48*b* from web member 48 and diverging leg 49*a* from web member 49 merge at their respective distal ends 48*b*' and 49*a*' to form an enlarged area 72 at the inside surface of end plate 46. Diverging leg 49*b* of web member 49 widens at its distal end 49*b*' to form an enlarged area 74 at the inside surface of end plate 46. The areas 70, 72 and 74 may be interconnected by a reinforcing rib 47 extending along the inside surface of end plate 46. The outer periphery of web members 48 and 49 along with the inside edge of reinforcing rib 47 and the entire central enlarged area 72 can be provided with a greater thickness in a direction parallel to the first-to-second end direction of the panels than the remaining area of the web members and reinforcing rib to provide greater rigidity to the entire bridging member 42. The greater thickness area around the outer periphery of web member 48 forms a rim 48*e*, and the greater thickness area around the outer periphery of web member 49 forms a rim 49*e*.

Symmetrically disposed on the opposite side of the vertical axis Y—Y, diverging leg 48*d* merges with end plate 44 at a distal end 48*d*' that widens into an area 71 at the inside surface of end plate 44. Diverging leg 48*c* of web member 48 and diverging leg 49*d* of web member 49 merge at their distal ends 48*c*' and 49*d*' into an area 73 at the inside surface of end plate 44. Diverging leg 49*c* of web member 49 merges at a distal end 49*c*' into an area 75 at the inside surface of the lower end 44*b* of end plate 44.

Symmetrically disposed on opposite sides of the vertical axis Y—Y of bridging member 42, strip members 60 and 62 intersect the diverging legs of web members 48 and 49 and abut and are substantially flush with inner surfaces 30 and 18 of panels 14 and 12, respectively. Each of the strip members 60 and 62 is substantially ski-shaped, with opposite ends 60*a* and 60*b* of strip member 60 curving outwardly toward end plate 46 and with opposite ends 62*a* and 62*b* of strip member 62 curving outwardly toward end plate 44. The width of strip members 60 and 62 in a direction along an axis Z (or in the first-to-second end direction of the foam panels and perpendicular to the page in FIG. 1) is greater than the width of the rest of the web members 48 and 49, including greater than the width of the thicker rim portion 48*e* around the outer periphery of web member 48 and the thicker rim portion 49*e* around the outer periphery of web 49.

The function of the strip members 60 and 62 is two-fold. During molding of the foam panels, they assist in positioning the bridging member 42 in the molds before the foam material is injected into the molds to form foam panels 12 and 14, and also help to seal against the flow of foam beyond the desired inner surfaces 30 and 18 of panels 14 and 12 respectively. Secondly, strip members 60, 62 function structurally to help resist forces imposed on the form when finishing materials are attached to the end plates 44, 46.

The web members having the above-described configuration can be sized to result in poured concrete walls having approximately 4 inches of concrete, 6.25 inches, 8 inches or other thicknesses of concrete between the foam panels. The dimensions of the web members between the strip members and the end plates can vary depending on whether the end plates are to be completely or partially buried within the foam panels, exposed or exposed and flush with the outer surfaces of the foam panels.

Figure 7:
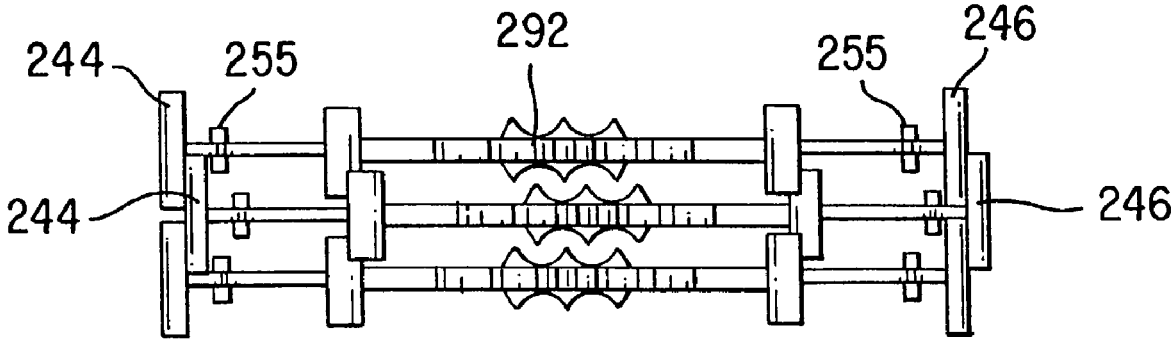
FIG. 7 is a side elevation view of a stack of bridging members constructed according to the principles of the invention having vertical rebar positioning features.

The top side of web member 48 and the bottom side of web member 49 can be profiled or otherwise formed to provide a series of seats for rebar positioning. Referring to FIG. 1, seats 90, 92 and 94 are generally curved to receive horizontal rebar rods. In addition to the seats on the sides of web members 48 and 49 toward the top and bottom of the panels, respectively, additional seating surfaces can be provided on the sides of the web members toward the first and second ends of the panels, such as seating surfaces 292 shown in FIG. 7. Seating surfaces provided on the sides of the web members towards the first and second ends of the panels provide seats for vertical rebar rods. Seating surfaces 292 shown in FIG. 7 are particularly important when the bridging members are approximately 4 inches wide to form 4 inch thick walls (i.e., a "4-inch form"). With a 4-inch form, the amount of concrete covering the vertical rebar between the vertical rebar and the foam panels as required by most building codes or other regulations necessitates accurate positioning of the vertical rebar.

In further embodiments shown in FIGS. 2–6, an alternative configuration for the web members described above was derived using finite element type structural analysis in order to maximize the strength of the bridging member while minimizing the amount of material used to form the member. The bridging member 142 shown in FIG. 5 includes a pair of elongated end plates 144 and 146 joined by web members 148 and 149, which may be generally symmetrically disposed above and below a central, horizontal axis X—X of the bridging member 142. Compared to the FIG. 1 embodiment, the web members 148, 149 have a slightly enlarged central portion, so the web members 148, 149 can be generally described as having a "double-Y" shape. As shown best in FIG. 5, top web member 148 has a mid portion 148*e* with two diverging legs 148*a* and 148*b* extending toward end plate 146 from one side of the mid portion 148*e* and two diverging legs 148*d* and 148*c* extending from the opposite side of mid portion 148*e* toward end plate 144. Similarly, web member 149 has two diverging legs 149*a* and 149*b* that extend from one end of mid portion 149*e* toward end plate 146, and two diverging legs 149*d* and 149*c* that extend from the opposite end of mid portion 149*e* toward end plate 144. The diverging legs of both web members 148 and 149 intersect with strip members 160 and 162 that extend in a top-to-bottom direction of the bridging member 142. Strip members 160 and 162 may be generally symmetrically disposed on both sides of a vertical axis Y—Y of the bridging member 142 (again, when each panel has the same width).

The strip members 160 and 162 are generally ski-shaped and include opposite ends 160*a*, 160*b*, 162*a* and 162*b* that curve outwardly toward respective end plates 146 and 144. The strip members 160 and 162 are also wider than the remaining portions of the web members in a direction parallel to the end plates (perpendicular to the page in FIG. 5). Similarly to the embodiment shown in FIG. 1, strip members 160 and 162 not only abut but are substantially flush with the inside surfaces of foam panels (not shown) to be molded to opposite end portions of the web members. The ski-shaped strip members 160 and 162 may have the same functions as strip members 60, 62 described above.

Diverging leg 148*a* of web member 148 merges with 3 further diverging legs, 170, 172 and 174 at strip member 160. Legs 170, 172 and 174 define two V-shaped portions extending between strip member 160 and end plate 146. The substantially triangular-shaped openings defined by the V-shaped portions, strip member 160 and end plate 146 allow for passage of foam when bridging member 142 is molded into two spaced parallel foam walls. Diverging leg 148*b* of web member 148 merges with a V-shaped portion defined by legs 176 and 178 extending from strip member 160 to end plate 146.

Web member 148 is substantially symmetrical about a vertical axis Y—Y of bridging member 142 such that diverging legs 148*d* and 148*c* diverging from mid portion 148*e* intersect with strip member 162 and merge into legs 171, 173, 175, 177 and 179 to form V-shaped portions extending between the strip member 162 and end plate 144.

Bridging member 142 is also substantially symmetrical about a horizontal axis X—X with web member 149 preferably being configured identically to web member 148. Diverging legs 149*a* and 149*b* extend from mid portion 149*e* of web member 149 toward end plate 146. The diverging legs 149*a* and 149*b* intersect with strip member 160, at which point they merge into legs 180, 182, 184, 186 and 188 to form V-shaped portions extending between strip member 160 and end plate 146. Similarly, on the opposite side of vertical axis Y—Y of bridging member 142, legs 149*d* and 149*c* diverge from mid portion 149*e* of web member 149 to intersect strip member 162, and then merge into legs 181, 183, 185, 187 and 189 to form V-shaped portions extending between strip member 162 and end plate 144. The V-shaped portions extending between strip member 162 and end plate 144 also define substantially triangular-shaped openings through which foam can pass when bridging member 142 is molded into two parallel spaced foam panels. The V-shaped portions on each side of the bridging member, i.e., the portions defined by legs 170, 172, 174, 176, 178, 180, 182, 184, 186, 188 on one hand and those defined by legs 171, 173, 175, 177, 179, 181, 183, 185, 187, 189 on the other hand, may be thought of as truss members extending between end plate 146 and strip member 160, or end plate 144 and strip member 162. The truss members may be formed with the end plates and strip members as an integral unit, which is then molded into the panels. The web members may be separately formed and snap fit or connected to projections extending from the strip members, in any conventional manner known in the art.

The opposite ends 162*a* and 162*b* of strip member 162 curve outwardly toward end plate 144, and the opposite ends 160*a* and 160*b* of strip member 160 curve outwardly toward end plate 146. Strip members 160 and 162 extend beyond web members 148 and 149 in both the top-to-bottom direction of bridging member 142 and in the perpendicular direction along axis Z (perpendicular to the page in FIG. 5).

Figure 5:
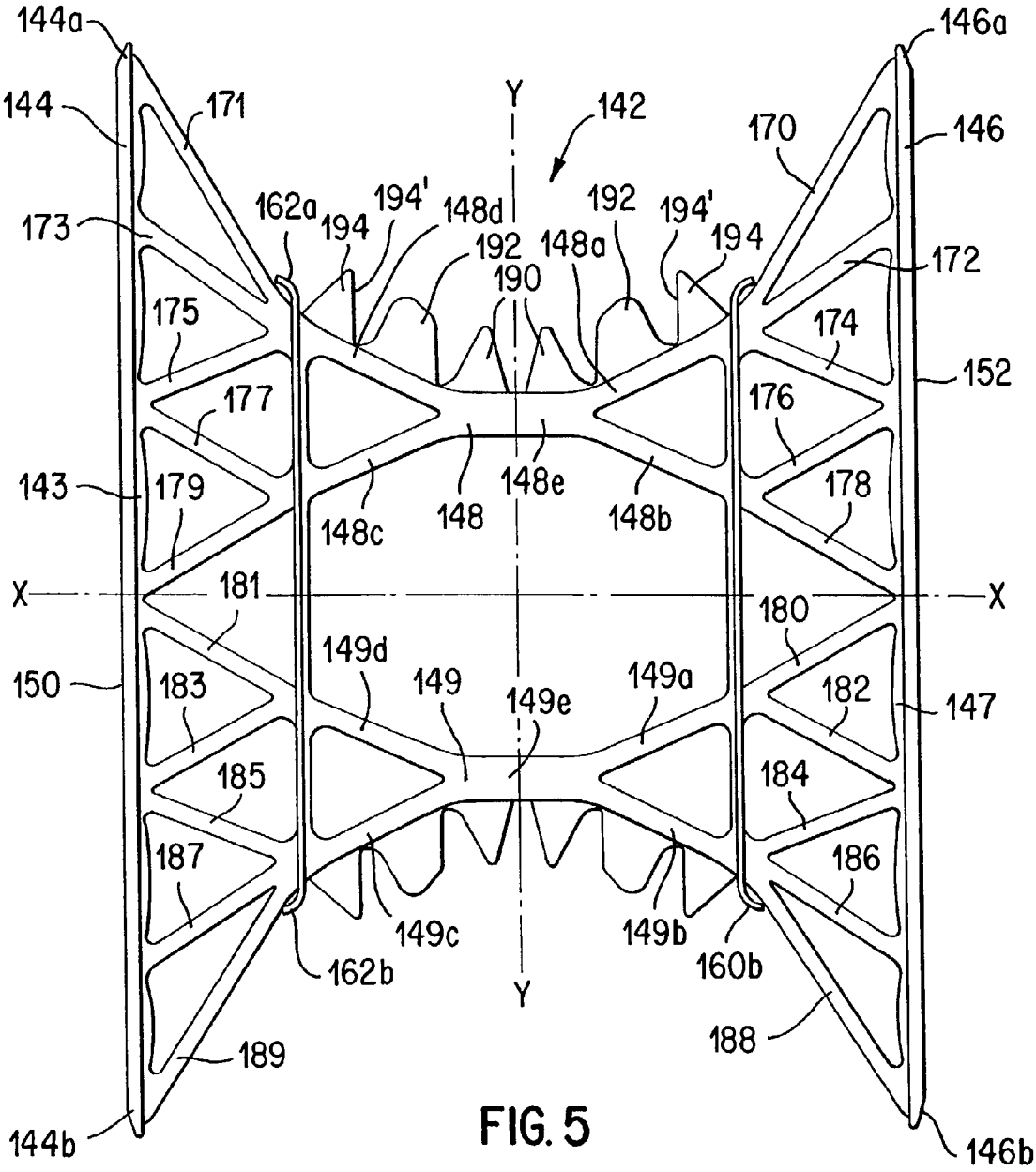
FIG. 5 is a side elevation view of a bridging member according to a fourth embodiment of the invention, which is similar to the third embodiment, except for the rebar positioning features.
Figure 6:
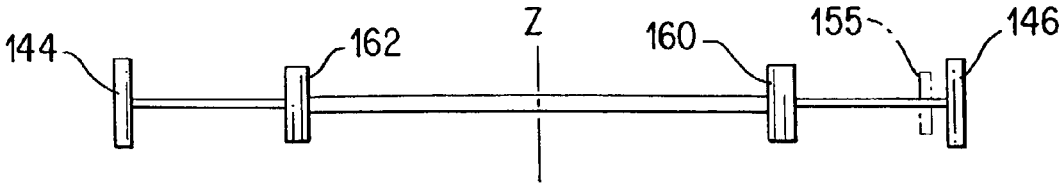
FIG. 6 is a top plan view of the bridging member of FIG. 5.

Triangular projections 190, 192 and 194 shown in FIG. 5 along a top edge of web member 148 and along a bottom edge of web member 149 define seating surfaces for horizontal rebar. The tapered openings between the triangular projections allow rebar of several different diameters including preferably at least up to #7 rebar to be positioned relative to bridging member 142. The inner edges 194' of outer triangular projections 194 can be substantially vertical or parallel to the end plates such that any size horizontal rebar placed in the seating surfaces defined between triangular projections 194 and 192 will be positioned with a uniform distance between the outer edge of the rebar and the outer edge of concrete poured between the opposing panels.

Stacking pins 155 shown in FIGS. 2–6 and 255 shown in FIG. 7 can also be provided to assist in positioning the bridging members relative to each other during shipping and storage. As seen in FIG. 7, an end plate 246 of one bridging member fits between the stacking pin 255 and end plate 246 of the bridging member on which it is stacked. The pins 155 may be integrally formed with the bridging members.

Building components formed with the above-described bridging members may be molded into parallel foam panels and can be stacked up to form walls such as described in more detail in U.S. Pat. Nos. 5,809,727, 5,657,600 and 5,390,459, which are herein incorporated in their entirety by reference. The configurations of the bridging members described above were arrived at using finite element type structural analysis to produce a configuration that enabled the use of a minimal amount of material while still providing sufficient lateral strength in the bridging members to withstand forces exerted by concrete (or other building material) poured in between the foam panels and to provide a uniform load distribution. Another design parameter considered when conceptualizing the above-described "double-Y" configuration was a reduction in the vertical height between the top of the middle portion of the top web member and the bottom of the middle portion of the bottom web member. The double-Y configuration enables a greater number of completed building components formed from the bridging members and the foam panels to be stacked in the same height for shipping.

While the invention has been described in conjunction with specific embodiments thereof, it is evident that many alternatives, modifications and variations will be apparent to those skilled in the art in light of the foregoing description. For example, the web members disposed above and below the horizontal axis of the bridging member could be varied so that the bridging member is not entirely symmetrical. The web members could have a substantially X-shaped configuration or a substantially Y-shaped configuration between the opposing end plates or between the opposing strip members. Additionally, the V-shaped portions extending between the strip members and the end plates could include cross-bracing members for additional stability such that the number of openings through which the foam can pass during molding of the building components is increased. Accordingly, the invention is intended to embrace all such alternatives, modifications and variations as fall within the spirit and broad scope of the appended claims.

What is claimed is:

1. Apparatus for connecting opposing panels of an insulated concrete form comprising:

a pair of elongated end plates;

a pair of generally X-shaped structural members with a first one of said members forming an X-shape above a central horizontal axis and a second one of said members forming an X-shape below the central horizontal axis, said pair of structural members joining said end plates and being substantially symmetrically disposed above and below the central horizontal axis of the connecting apparatus, one of said X-shape structural members includes at least one lower leg having a different dimension than at least one lower leg of the other structural member, said structural members being configured to maximize load bearing capacity with a minimum amount of material; and at least one retaining member intersecting one of said structural members to assist in positioning the connecting apparatus relative to the panels and resisting external loads applied to the end plates.

2. The apparatus according to claim 1, wherein said at least one retaining member intersects said structural members on one side of a central vertical axis of the apparatus.

3. The apparatus according to claim 1, wherein said at least one retaining member comprises a ski-shaped strip member having curved ends.

4. The apparatus according to claim 3, wherein said curved ends of said ski-shaped strip member curve outwardly toward one of said end plates.

5. The apparatus according to claim 3, wherein said strip member is wider than said structural members in a direction substantially parallel to said end plate.

6. The apparatus according to claim 1, wherein said structural members include receptacles for positioning at least one of horizontally or vertically disposed rebar.

7. The apparatus according to claim 1, wherein at least one of said structural members has one of a generally X-shaped portion and a generally double-Y shaped portion between said end plates.

8. The apparatus according to claim 7, wherein said at least one retaining member comprises two retaining members intersecting said structural members on each side of a central vertical axis of the apparatus, and each of said structural members has one of a generally X-shaped portion and a generally Y-shaped portion between said retaining members.

9. The apparatus according to claim 1, wherein said end plates, said structural members and said at least one retaining member are formed integrally from a single piece of material.

10. The apparatus according to claim 1, further comprising legs defining V-shaped portions extending between said at least one retaining member and one of said end plates.

11. The apparatus according to claim 10, wherein said V-shaped portions define a plurality of triangular-shaped openings for passage of foam during the molding of the panels.

12. Apparatus for connecting opposing panels of an insulated concrete form comprising:

a pair of elongated end plates;

a pair of structural members joining said end plates and being substantially symmetrically disposed above and below a central horizontal axis of the connecting apparatus, said structural members being configured to maximize load bearing capacity with a minimum amount of material; and at least one retaining member intersecting one of said structural members to assist in positioning the connecting apparatus relative to the panels and resisting external forces applied to said endplates, wherein said at least one retaining member comprises a ski-shaped strip member having at least one radiused end curved outwardly toward one of said end plates.

13. The apparatus of claim 12, wherein said strip member is wider than said structural members in a direction substantially parallel to said end plates.

14. The apparatus of claim 12, wherein both ends of said at least one retaining member are radiused and curved outwardly toward one of said end plates.

15. Apparatus for connecting opposing panels of an insulating concrete form comprising:

a pair of elongated end plates;

a pair of structural members joining said end plates and being substantially symmetrically disposed above and below a central horizontal axis of the connecting apparatus, said structural members being configured to maximize load bearing capacity with a minimum amount of material; and at least one retaining member intersecting one of said structural members to assist in positioning the connecting apparatus relative to the panels, wherein said at least one retaining member comprises a ski-shaped strip member having curved ends and said curved ends curve outwardly toward one of said end plates.

16. The apparatus of claim 15, wherein said strip member is wider than said structural members in a direction substantially parallel to said end plates.

* * * * *